US007225925B2

(12) United States Patent
Chen et al.

(10) Patent No.: US 7,225,925 B2
(45) Date of Patent: Jun. 5, 2007

(54) SHOCK ABSORBENT PACKAGING STRUCTURE

(75) Inventors: Chiu-Chun Chen, Jhudong Township, Hsinchu County (TW); Bo-Chi Chou, Taipei (TW); Wen-Yuan Chang, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 388 days.

(21) Appl. No.: 10/864,826

(22) Filed: Jun. 9, 2004

(65) Prior Publication Data

US 2005/0173294 A1 Aug. 11, 2005

(30) Foreign Application Priority Data

Feb. 6, 2004 (TW) ..... 93201672 U

(51) Int. Cl.
*B65D 85/48* (2006.01)
*B65D 85/30* (2006.01)

(52) U.S. Cl. ..... 206/454; 206/587; 206/521; 206/593; 206/485

(58) Field of Classification Search ..... 206/454, 206/586–594, 521, 328, 485, 725, 522, 523, 206/425, 561; 220/529, 532, 533; 229/120.34, 229/120.02
See application file for complete search history.

(56) References Cited

U.S. PATENT DOCUMENTS

| | | | | | |
|---|---|---|---|---|---|
| 4,164,312 | A * | 8/1979 | Harned | 229/120.38 |
| 4,339,039 | A * | 7/1982 | Mykleby | 206/523 |
| 4,779,752 | A * | 10/1988 | Vallee et al. | 220/533 |
| 4,798,305 | A * | 1/1989 | Laverty | 220/533 |
| 4,828,133 | A * | 5/1989 | Hougendobler | 220/533 |
| 5,152,395 | A * | 10/1992 | Cross | 206/389 |
| 5,299,688 | A * | 4/1994 | McKay et al. | 206/425 |
| 5,464,091 | A * | 11/1995 | Callahan et al. | 206/308.3 |
| 5,775,522 | A * | 7/1998 | Martin, Sr. | 211/184 |
| 6,010,007 | A * | 1/2000 | Moren et al. | 206/587 |
| 6,145,663 | A * | 11/2000 | Kim et al. | 206/454 |
| 2001/0027934 | A1 * | 10/2001 | Yoneda et al. | 206/725 |
| 2003/0160052 | A1 * | 8/2003 | Mulaw | 220/532 |

* cited by examiner

*Primary Examiner*—Mickey Yu
*Assistant Examiner*—Steven A. Reynolds
(74) *Attorney, Agent, or Firm*—Thomas, Kayden, Horstemeyer & Risley

(57) ABSTRACT

A packaging structure for a container. The packaging structure includes a main frame including a first portion, a second portion and a connecting plate connecting the first and second portions, and a plurality of separators inserted in first and second grooves defined at the first and second portions respectively. The glass substrate is sealed in a loading slot formed by the separators.

18 Claims, 6 Drawing Sheets

SHOCK ABSORBENT PACKAGING STRUCTURE

BACKGROUND OF THE INVENTION

1. Field of the Invention

The present invention relates to a shock absorbent packaging structure, and in particular to a packaging structure provided with a larger loading area for better shock absorption.

2. Description of the Related Art

A glass substrate for a liquid crystal panel, either unprocessed or substrate, must be transported in a special container to avoid damage caused by impact. Conventionally, a shock absorbent packaging structure of foam material is inserted in a container for the glass substrate. However, the foam structure must provide a considerable thickness for shock absorption. This results in a large volume, creating a serious problem for storage. Therefore, long paper plates have become preferred rather than the foam material.

FIG. 1 shows a conventional shock absorbent packaging structure using paper plates. The packaging structure 10 in FIG. 1 comprises a main frame 20 and a carrying body 30 provided with a plurality of separators 311 and grooves 312 formed by the separators 311. Two symmetrical packaging structures 10 are placed in the container 4. The glass substrate 5 is sealed in the grooves 312.

However, in such structure, only the sides of the glass substrate 5 are secured by the main frame 20, providing only a minimum of shock absorption.

SUMMARY OF THE INVENTION

Accordingly, an object of the invention is to provide a packaging structure with larger loading area to enhance shock absorbent ability.

The packaging structure of the invention comprises a main frame and a plurality of separators. The main frame comprises a rectangular first portion, a rectangular second portion and a connecting plate. The first portion has an outer wall, an inner wall, a top wall, a bottom wall and a plurality of grooves disposed on the inner wall perpendicular to the top wall. The second portion also has an outer wall, an inner wall opposite to the first portion inner wall, a top wall, a bottom wall and a plurality of grooves disposed on the second portion inner wall perpendicular to the second portion top wall and aligned with the first portion grooves. The connecting plate connects the first portion inner wall and the second portion inner wall. Thus, when a glass substrate is placed between two separators, the connecting plate provides additional loading area.

The separators have one top side, one bottom side and two lateral sides inserted in the first and second grooves respectively. The bottom side of the separator abuts the connecting plate when the separator is sealed in the first and second grooves. The separator has a notch at the top side enabling easy removal of the glass substrate from the first and second grooves.

The main frame, formed by folding a long paper plate, is divided into: a first section having a plurality of slots, a second section, a third section, a fourth section, a fifth section having a plurality of slots aligned with the first section slots and extending to the fourth section, a sixth section, a seventh section having a plurality of slots corresponding to the first section slots, a eighth section, a ninth section, a tenth section and a eleventh section having a plurality of slots extending to the eighth section, corresponding to the fifth section slots.

The first section, the second section, the third section, the fourth section and the fifth section are correspond to the eleventh section, the tenth section, the ninth section, the eighth section and the seventh section respectively, with respect to the sixth section.

The long plate is folded such that the first, second, third, fourth, fifth, sixth, seventh, eighth, ninth, tenth and eleventh sections form respectively a first plate, the first bottom wall, the first outer wall, the first top wall, a second plate, the connecting plate, a third plate, the second top wall, the second outer wall, the second bottom wall and a fourth plate; the first section slots overlap the fifth section slots to form the first portion grooves, and the seven section slots overlaps the eleventh section slots to form the second portion grooves. The second plate is bonded to the first plate to form the first inner wall, and the fourth plate is bonded to the third plate to form the second inner wall, thereby providing stiffness and rigidity of the first and second portions.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
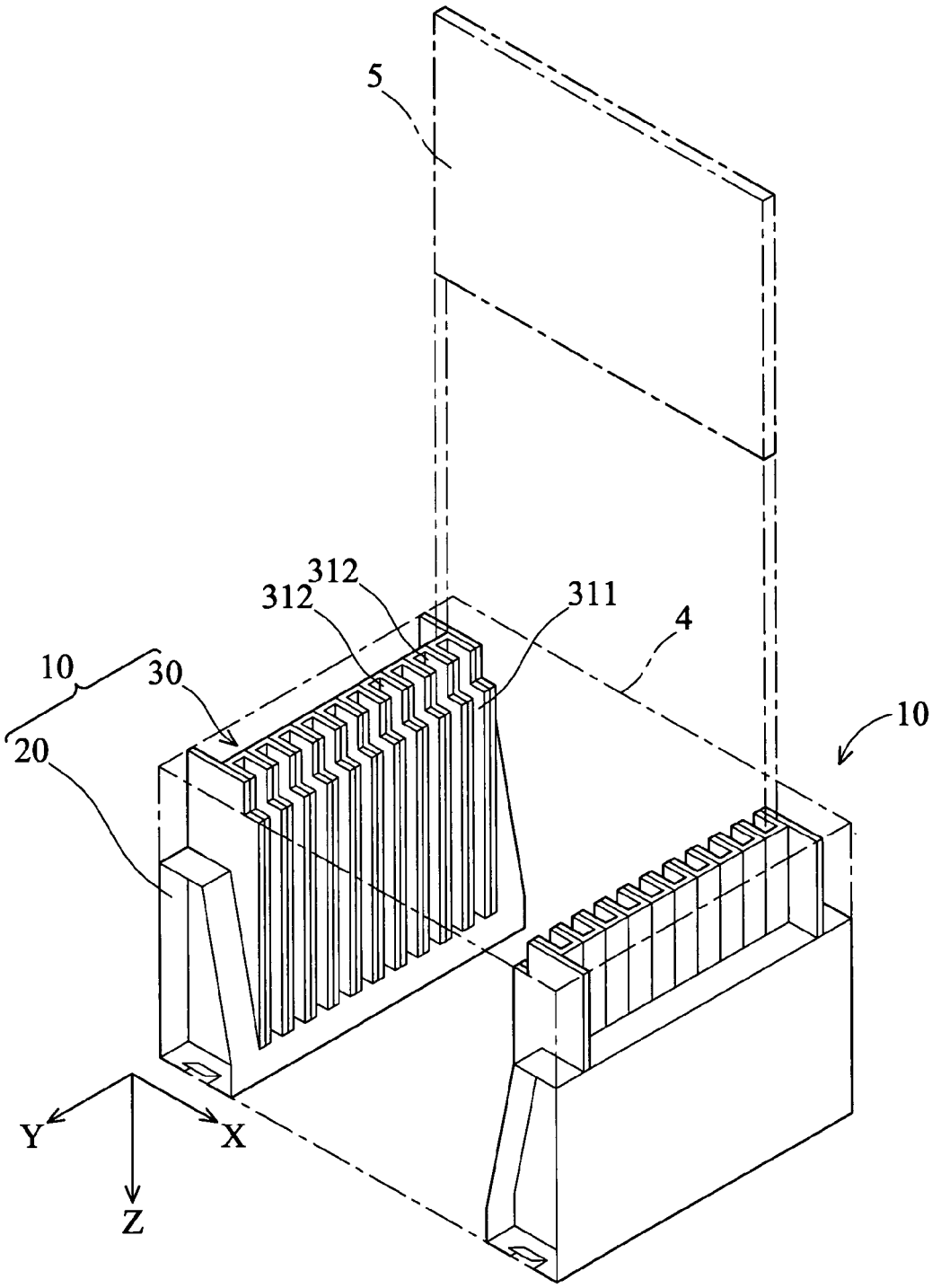
FIG. 1 (RELATED ART)
FIG. 1 is a perspective view of a conventional shock absorbent packaging structure.
Figure 2:
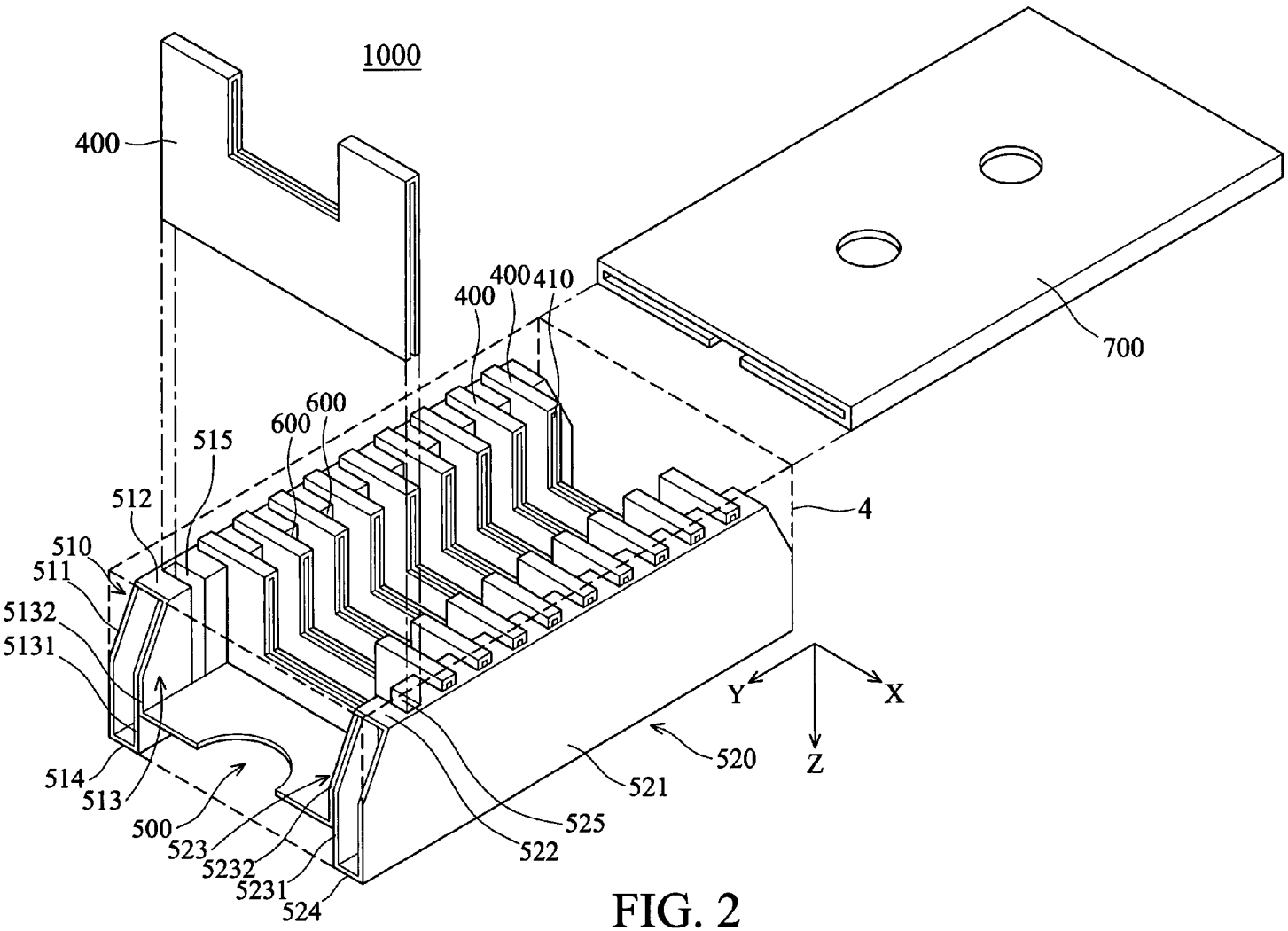
FIG. 2 is a perspective view of a shock absorbent packaging structure of the invention.

FIG. 2 is a perspective view of a packaging structure of the invention. The packaging structure 1000 of the invention comprises a main frame 500 and a plurality of separators 400. The main frame comprises a first portion 510, a second portion 520 and a connecting plate 530 connecting the first portion 510 and the second portion 520. The first portion 510 is substantially rectangular and includes an outer wall 511, a top wall 512, an inner wall 513 and a bottom wall 514. The second portion 520 is also substantially rectangular and symmetrical to the first portion 510 with respect to the connecting plate 530. Similarly, the second portion 520 includes an outer wall 521, a top wall 522, an inner wall 523 and a bottom wall 524. The connecting plate 530 connects the first portion inner wall 513 and the second portion inner wall 523.

A plurality of first grooves 515 is defined on the first portion inner wall 513 perpendicular to the first portion top wall 512. Similarly, a plurality of second grooves 525 is defined on the second portion inner wall 523 and perpendicular to the second portion top wall 522, and the second grooves 525 align the first grooves 515.

Figure 3:
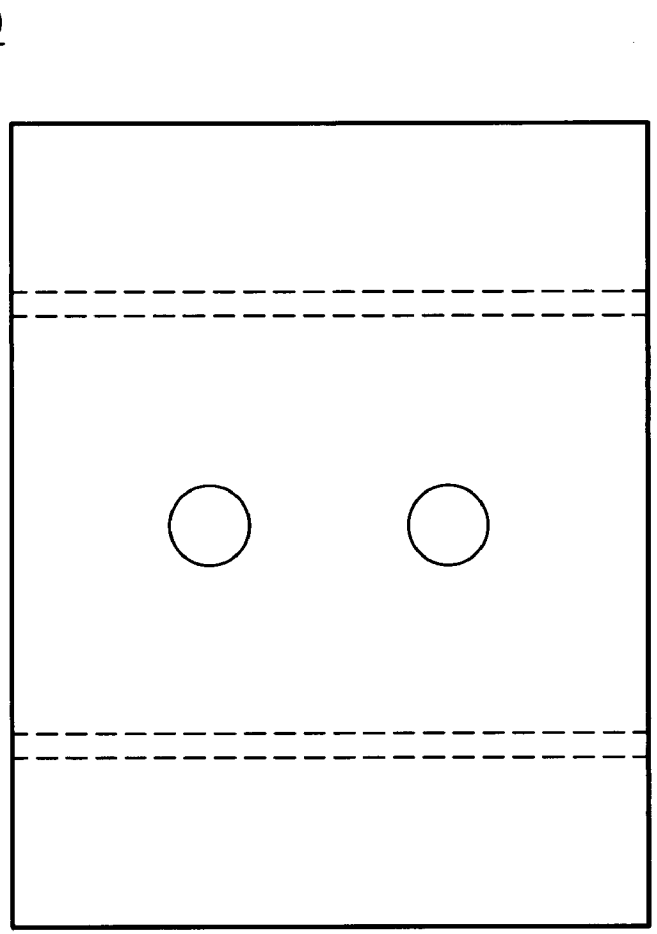
FIG. 3 is a developed view of a cover plate of the invention.

A plurality of separators 400 is inserted into the first and second grooves 515, 525 to form a plurality of loading slots 600 for accommodating glass substrates (not shown). Because the first and second grooves 515, 525 are equidistant, each loading slot 600 has the same width. In this embodiment, when the separator 400 is inserted into the first and second grooves 515, 525, the bottom of the separator 400 abuts the connecting plate 300, and the top side thereof is at the same height as the first and second top wall 512, 522. Thereby, a cover plate 700 formed by folding a paper plate as shown in FIG. 3 can be placed over the main frame 500.

Figure 4:
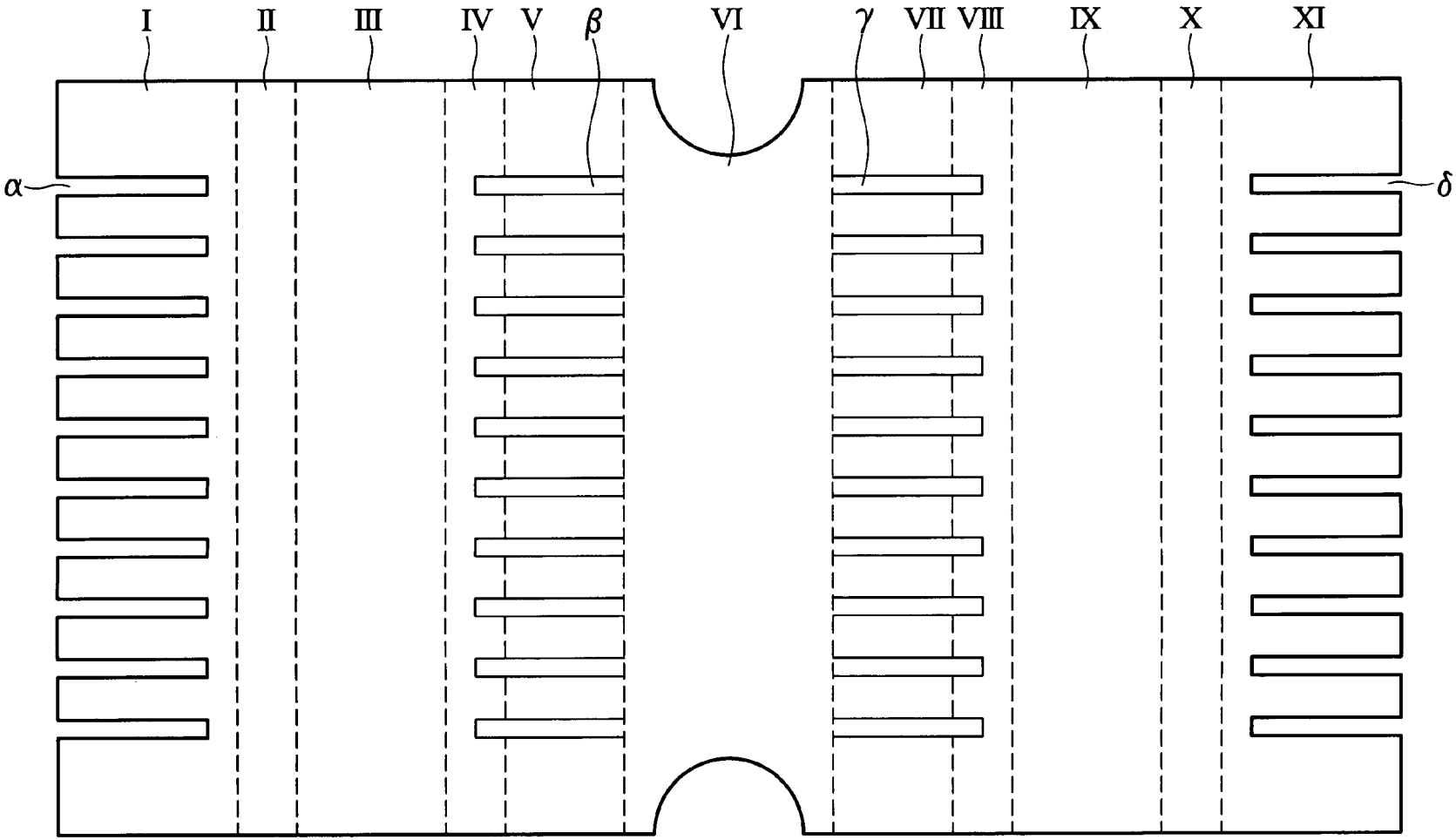
FIG. 4 is a developed view of a main frame of the shock absorbent packaging structure of the invention.

The main frame 500 of the invention is formed by folding a long paper plate as shown in FIG. 4. The unfolded long paper plate is divided into the following sections by several folding lines: a first section I, a second section II, a third section III, a fourth section IV, a fifth section V, a sixth section VI, a seventh section VII, a eighth section VIII, a ninth section IX, a tenth section X and a eleventh section XI. The long paper plate is folded based on the folding lines to form the first and second portions 510, 520 of the main frame 500. The sections described above correspond respectively to a first plate 5131, the first portion bottom wall 514, the first portion outer wall 511, the first portion top wall 512, a second plate 5132, the connecting plate 530, a third plate 5232, the second portion top wall 522, the second portion outer wall 521, the second portion bottom wall 524 and a fourth plate 5231. A plurality of first slots $\alpha$ is defined in the first section I, and a plurality of second slots $\beta$ is defined in the fourth and fifth sections IV, V and aligned with the first slots $\alpha$. A plurality of third slots $\gamma$ is defined in the seventh section VII corresponding to the first slots $\alpha$, and a plurality of fourth slots $\delta$ is defined in the eighth and eleventh sections VIII, XI corresponding to the second slots $\beta$. When the long paper plate is folded, the first slot $\alpha$ corresponds to the second slots $\beta$ to form the first groove 515, and the third slot $\gamma$ corresponds to the fourth slots $\delta$ to form the second groove 525. Moreover, the first plate 5131 is bonded to the second plate 5132 to form the first inner wall 513, and the third plate 5232 is bonded to the fourth plate 5231 to form the second inner wall 523, thus providing stiffness and rigidity of the first and second portions 510, 520.

Figure 5:
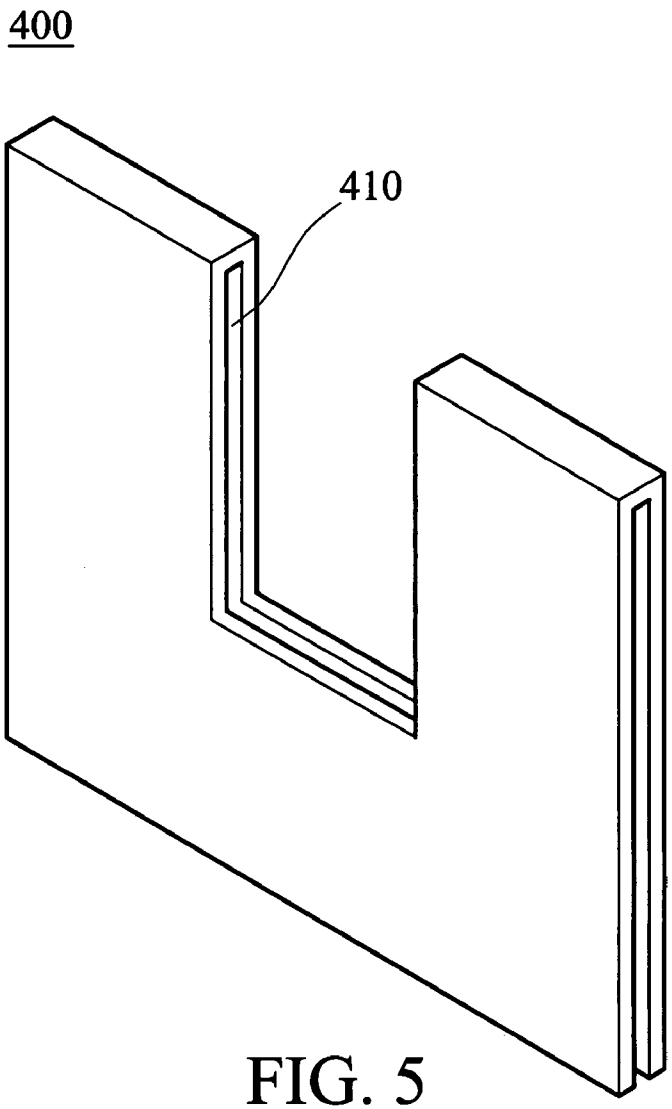
FIG. 5 is a perspective view of a separator of the shock absorbent packaging structure of the invention.
Figure 6:
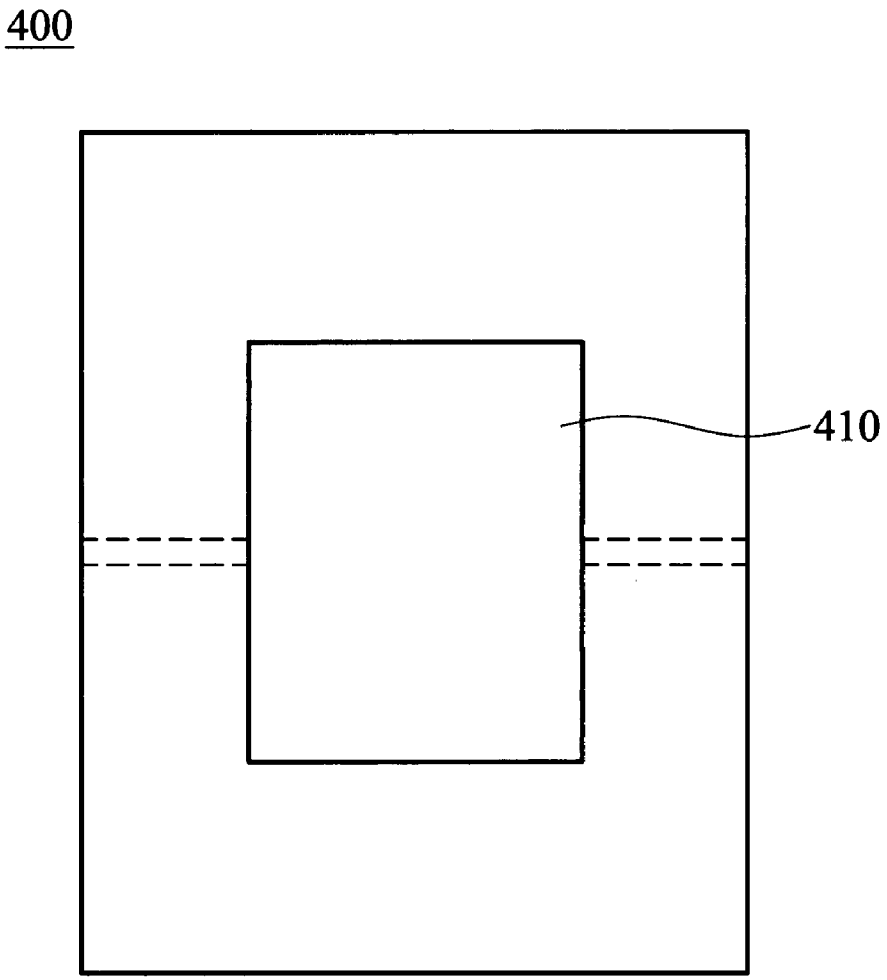
FIG. 6 is a developed view of the separator of the invention.

As shown in FIGS. 5 and 6, the separator 400 is formed by folding a paper plate into a two-layered structure to enhance shock absorption. In addition, a notch 410 is defined at the top of the separator 400 enabling easy removal of the glass substrate. Although two-layer structure is disclosed for the separator 400 in this embodiment, a single or multi-layered structure can also be applied.

In the packaging structure disclosed, the glass substrate is sealed in the loading slot 600 and loaded by the connecting plate 530 in z direction such that a larger loading area is available. Additionally, the separator 400 provides the glass substrate with more protection for additional contacting area in y direction. In x direction, as the thicknesses of the first portion 510 and the second portion 520 are increase, shock absorption is enhanced as the entire strength of the packaging structure is reinforced.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A packing structure for a container, comprising:

a main frame comprising:

a rectangular first portion having an outer wall, an inner wall, a top wall, a bottom wall and a plurality of grooves disposed on the inner wall;

a rectangular second portion having a outer wall, a inner wall opposite to the first portion inner wall, a top wall, a bottom wall and a plurality of grooves disposed on the inner wall and aligned with the first portion grooves and;

a connecting plate connecting the inner wall of the first portion and the inner wall of the second portion, wherein the main frame is formed by folding a long plate; and a plurality of separators comprising one top side, one bottom side and two lateral sides inserted in the first and second grooves respectively.

2. The packing structure as claimed in claim 1, wherein the bottom of the separator abuts the connecting plate when the separator is inserted into the first and second portion grooves.

3. The packing structure as claimed in claim 1, wherein the separator has a notch at the top side.

4. The packing structure as claimed in claim 3, wherein the separator is rectangular.

5. The packing structure as claimed in claim 1, wherein the top side of the separator is the same height as the first and second portion top walls when the separator is inserted into the first and second portion grooves.

6. The packing structure as claimed in claim 1, wherein the separator is double-layered by folding a long paper plate.

7. The packing structure as claimed in claim 1, wherein the separator is single-layered.

8. The packing structure as claimed in claim 1, wherein the separators are equidistant.

9. The packing structure as claimed in claim 1 further comprising a cover plate covering the main frame.

10. The packing structure as claimed in claim 9, wherein the cover plate is rectangular and comprises a folded long paper plate.

11. A long plate for the main frame claimed in claim 1, comprising:

a first section comprising a plurality of slots, a second section, a third section, a fourth section, a fifth section having a plurality of slots aligned with the first section slots and extending to the fourth section, a sixth section, a seventh section having a plurality of slots corresponding to the first section slots, a eighth section, a ninth section, a tenth section and a eleventh section having a plurality of slots extending to the eighth section corresponding to the fifth section slots;

wherein the first section, the second section, the third section, the fourth section and the fifth section correspond to the eleventh section, the tenth section, the ninth section, the eighth section and the seventh section respectively, with respect to the sixth section; the long plate is folded such that the first, second, third, fourth, fifth, sixth, seventh, eighth, ninth, tenth and eleventh sections form respectively a first plate, the first portion bottom wall, the first portion outer wall, the first portion top wall, a second plate combined with the first plate to form the first portion inner wall, the connecting plate, a third plate, the second portion top wall, the second portion outer wall, the second portion bottom wall and a fourth plate combined with the third plate to form the second portion inner wall; the first section slots overlap the fifth section slots to form the first portion grooves, and the seventh section slots overlap the eleventh section slots to form the second portion grooves.

12. The long plate as claimed in claim 11, wherein the first section is the same width as the third section.

13. The long plate as claimed in claim 11, wherein the second section is the same width as the fourth section.

14. The long plate as claimed in claim 11, wherein the first plate is bonded to the second plate.

15. The long plate as claimed in claim 11, wherein the third plate is bonded to the fourth plate.

16. The long plate as claimed in claim 11, wherein the first, fifth, seventh and eleventh section slots are equidistant.

17. The packing structure as claimed in claim 1, wherein the inner wall of the first portion is perpendicular to the top wall of the first portion.

18. The packing structure as claimed in claim 1, wherein the inner wall of the second portion is perpendicular to the top wall of the second portion.

* * * * *